US008687467B2

(12) United States Patent
Comeau

(10) Patent No.: US 8,687,467 B2
(45) Date of Patent: Apr. 1, 2014

(54) SYSTEM AND METHOD FOR DISPLAYING TIME

(76) Inventor: John R. Comeau, New York, NY (US)

( * ) Notice: Subject to any disclaimer, the term of this patent is extended or adjusted under 35 U.S.C. 154(b) by 727 days.

(21) Appl. No.: 12/939,655

(22) Filed: Nov. 4, 2010

(65) Prior Publication Data

US 2012/0113766 A1 May 10, 2012

(51) Int. Cl.
*G04C 19/00* (2006.01)

(52) U.S. Cl.
USPC ..... 368/82; 368/239; 368/223

(58) Field of Classification Search
USPC ..... 368/77, 79, 82, 84, 223, 233, 239, 242
See application file for complete search history.

(56) References Cited

U.S. PATENT DOCUMENTS

| | | | | |
|---|---|---|---|---|
| 3,597,912 | A * | 8/1971 | Akahano | 368/37 |
| 5,898,645 | A * | 4/1999 | Sugiyama | 368/82 |
| 6,097,390 | A * | 8/2000 | Marks | 715/772 |
| 6,198,698 | B1 | 3/2001 | Graves | |
| 6,266,295 | B1 * | 7/2001 | Parker et al. | 368/28 |
| 6,813,222 | B1 | 11/2004 | De Salivet De Fouchecour | |
| 6,826,774 | B1 * | 11/2004 | Holme | 725/39 |
| 7,218,575 | B2 | 5/2007 | Rosevear | |
| 7,274,375 | B1 * | 9/2007 | David | 345/619 |
| 7,362,662 | B2 | 4/2008 | Lang | |
| 7,738,320 | B2 * | 6/2010 | Taha | 368/10 |
| 2001/0055244 | A1 * | 12/2001 | Kim | 368/73 |
| 2004/0225966 | A1 * | 11/2004 | Besharat et al. | 715/705 |

OTHER PUBLICATIONS

Dragicevic, P. and S. Huot, "SpiraClock: A Continuous and Non-Intrusive Display for Upcoming Events," Conference on Human Factors in Computing Systems, CHI' 2002 extended abstracts on Human factors in computing systems.

* cited by examiner

*Primary Examiner* — Amy Cohen Johnson
*Assistant Examiner* — Jason Collins
(74) *Attorney, Agent, or Firm* — Pearl Cohen Zedek Latzer Baratz LLP

(57) ABSTRACT

A visual display and device and method for producing the display may indicate the time or other data in a bold, elegant, intuitive, and stylistic manner that is easily legible despite obscured vision, viewing distances, or the user's inattentiveness. A minimalistic display may include a shape such as a geometric shape that presents the time by connecting the distal ends of the hour and minute indicators with a possibly time-varying curve. This curve aids in the interpretation of the time. Another embodiment of the invention displays, using a polar coordinate system, two physical parameters on single similar display in an aesthetically-pleasing, elegant, and intuitive method.

15 Claims, 7 Drawing Sheets

SYSTEM AND METHOD FOR DISPLAYING TIME

PRIOR APPLICATION DATA

The present application claims the benefit of prior provisional application 60/280,490, filed on Nov. 5, 2009, entitled "Timepiece indicating time including a shape between two segments" incorporated by reference herein in its entirety.

FIELD OF THE INVENTION

The present invention relates to an easy-to-read clock, display or timepiece.

BACKGROUND

Inattentive users, users facing intervening atmospheric conditions, and users with uncorrected vision problems, such as myopia, may have difficulty correctly reading the time presented by prior art devices and displays.

Prior art devices and displays include digital representations that may present a digital format of a one- or two-digit hour and a two-digit minute, e.g. 12:34 or 2:45. Such representations are very poor at addressing the above problems. They may suffer from misinterpretation of the digits, especially when viewed by individuals with uncorrected vision problems, such as myopia. Misinterpretation may result from commonly confused numeral pairs, examples of which are listed below:

3 vs. 8
1 vs. 7
5 vs. 6
4 vs. 9

Prior art devices and displays include representations where the hour or minute is represented in an "analog", or continuous, manner. Such devices may present two hands of, for example, simple rectangular or linear shapes, or other shapes (e.g., an hour hand and a minute hand; possibly with the addition of a second hand). While the hands may have decorative details, the hands retain a generally rectangular or oblong shape. Prior art includes a traditional clock face, an example of which is shown in FIG. 1 (showing thirty-eight minutes after four o'clock), which may suffer from the following problems, especially when viewed by individuals with uncorrected vision problems such as myopia. The problems are listed in order of the severity of the resultant error in time measurement:

a. confusion between the hour and minute hands
b. misinterpretation of the position of the hour hand
c. misinterpretation of the position of the minute hand Prior art devices and displays include a timepiece that displays the minutes in the manner of a pie chart and thus leaves a misleading and meaningless edge at the twelve o'clock position and also fails to present the hour in a consistent or analog manner, either using a illuminated hour marker or a color choice that encodes the hour in an unfamiliar way. The hour is not itself included in the pie chart.

Prior art displays may show sunrise or sunset in the manner of, for example, a pie chart that leaves a misleading and meaningless edge at the twelve o'clock position and also fails to prioritize and make prominent the most important function, that of indicating the current time.

One prior art display includes a timepiece that uses a time-invariant spiral to indicate the minutes. A related prior art device likewise uses fixed graphical, filled, monochrome spiral that does not originate at zero but requires a third color to perform the functions of indicating hours and minutes.

SUMMARY

The present invention addresses some problems of the prior art. Embodiments may provide an analog rather than problematic digital (e.g., using digits to display time as, e.g., 12:00) display; may present a bold, elegant, minimalistic and very legible geometric shape that incorporates in some cases every aspect of the shape and orientation to communicate the time (e.g., the current time, elapsed time, or another time); and may present time in familiar and thus intuitive manner. Embodiments may display the time with two colors or patterns, and thus achieve a highly distinct, intuitive, elegant, and legible solution.

An embodiment of the invention utilizes a central processing unit, memory, and a graphical display to present the time with a simple geometrical figure. An embodiment may present a solid figure that is bounded by two indicia, the proximal ends meeting at a center of a dial or other round or semi-round shape, the distal ends of which are connected by a monotonically-increasing radial function, which may take the shape of a logarithmic spiral. The curve that connects the indicia may be time-variant as an agent of further communicating the time.

An objective of the invention is to display the time in a manner that will be more legible despite the effects of the user's inattentiveness, the user's vision impairments, atmospheric conditions partially obscuring the display, or a great viewing distance.

Another objective of the invention is to create an elegant and intuitive time display that will not require a radically different, compared to prior art, interpretation of the display. Thus the invention may facilitate learning to interpret the novel display.

The curve itself or the shape itself, without reference to another indication, may represent both the hour and the minute.

Other embodiments of the invention may display two physical parameters (e.g., as opposed to time parameters of hours and minutes) in a polar coordinate system and with a similar graphical presentation.

A visual display and device and method for producing the display may indicate the time or other data in a bold, elegant, intuitive, and stylistic manner. A minimalistic display may include a shape, such as a geometric shape that presents the time by connecting the distal ends of the hour and minute indicators with a possibly time-varying curve. Another embodiment of the invention displays, using a polar coordinate system, two physical parameters on single similar display in an aesthetically-pleasing, elegant, and intuitive method.

Embodiments of the invention provide an aesthetically-pleasing, elegant, and intuitive method for displaying the time and may provide superior legibility, especially when interpretation is impaired by, for example, inattentiveness, problems with the user's vision, atmospheric conditions or distance between the timepiece and the user. Another embodiment of the invention relates to a method of displaying, using a polar coordinate system, two physical parameters on a single display in an aesthetically-pleasing, elegant, and intuitive method.

A device, method or display according to an embodiment of the present invention may display or render on a monitor, screen or display a graphical shape (e.g., a filled shape) bounded by:

originating at a center on a face displayed on the display, a first line segment, the first line segment indicating an first parameter and having a first end at the center and distal end; and originating at said center, a second line segment longer than the first line segment the second line segment indicating a second parameter and having a first end at the center and distal end; and a curve beginning at the distal end of said first line segment and ending at the distal end of said second line segment and determined by a radial function that is monotonically-increasing over at least a majority of the radial distance between the distal ends of the line segments, with the origin at said center, over the domain of the reflex or straight angle formed at the center by the two line segments;

the graphical shape indicating a measurement such as a physical measurement or another measurement, or the current time or another time wherein the first parameter is the hour and the second parameter is the minute.

The device may include an electronic display unit capable of rendering graphics, a memory, and a processor or controller, e.g., carrying out or executing instructions or code.

The one or more physical measurements may be two physical measurements, and the angle between the first line segment and a fixed reference angle may be proportional to the first of two physical measurements, and the angle between the second line segment and a fixed reference angle may be proportional to the second of two physical measurements.

The measurement for the reference angle may begin at the topmost position, e.g. equivalent to twelve-o'clock, but other starting points may be used.

The monotonically-increasing radial function forming a boundary of the shape may have a domain consisting of the acute, right, or obtuse angle formed by the two segments.

The curve connecting the distal ends of the segments may be determined by a radial function that is monotonically-increasing over the entirety of the radial distance between the distal ends of the line segments.

BRIEF DESCRIPTION OF THE DRAWINGS

The principles and operation of the device and method according to the present invention may be better understood with reference to the drawings, and the following description, it being understood that these drawings are given for illustrative purposes only and are not meant to be limiting, wherein.

Figure 1:
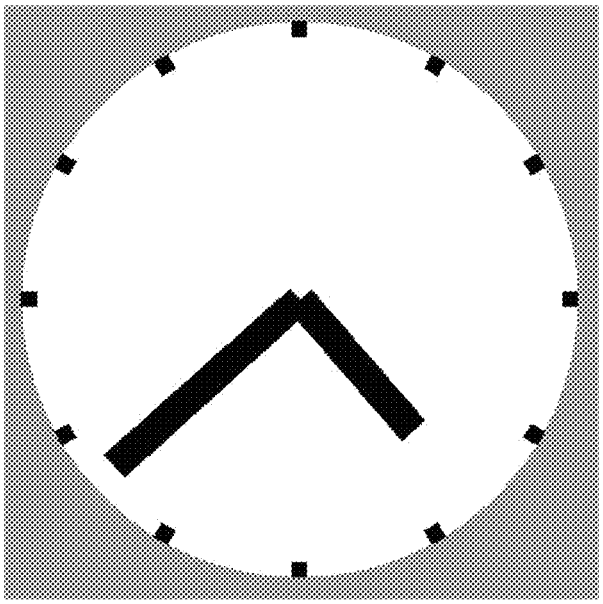
Fig. 1 (PRIOR ART)
FIG. 1 shows a prior art display indicating thirty-eight minutes after four o'clock.

It will be appreciated that for simplicity and clarity of illustration, elements shown in the figures have not necessarily been drawn to scale. For example, the dimensions and/or aspect ratio of some of the elements may be exaggerated relative to other elements for clarity. Further, where considered appropriate, reference numerals may be repeated among the figures to indicate corresponding or analogous elements throughout the serial views.

DETAILED DESCRIPTION OF THE PREFERRED EMBODIMENTS

In the following description, various aspects of the present invention will be described. For purposes of explanation, specific configurations and details are set forth in order to provide a thorough understanding of the present invention. However, it will also be apparent to one skilled in the art that the present invention may be practiced without the specific details presented herein. Furthermore, well known features may be omitted or simplified in order not to obscure the present invention.

Unless specifically stated otherwise, as apparent from the following discussions, it is appreciated that throughout the specification discussions utilizing terms such as "processing", "computing", "storing", "determining", or the like, refer to the action and/or processes of a computer or computing system, or similar electronic computing device, that manipulates and/or transforms data represented as physical, such as electronic, quantities within the computing system's registers and/or memories into other data similarly represented as physical quantities within the computing system's memories, registers or other such information storage, transmission or display devices.

Embodiments of the present invention may include apparatus for performing the operations herein. Such apparatus may be specially constructed for the desired purposes, or may include general purpose computers selectively activated or reconfigured by a computer program stored in the computers. Such computer programs may be stored in a computer readable storage medium, such as, but is not limited to, any type of disk including floppy disks, optical disks, CD-ROMs, magnetic-optical disks, read-only memories (ROMs), random access memories (RAMs) electrically programmable read-only memories (EPROMs), electrically erasable and programmable read only memories (EEPROMs), magnetic or optical cards, or any other type of media suitable for storing electronic instructions, and capable of being coupled to a computer system bus.

The processes and displays presented herein, when a computer-implemented embodiment is described, are not inherently related to any particular computer or other apparatus. Various general purpose systems may be used with programs in accordance with the teachings herein, or it may prove convenient to construct a more specialized apparatus to perform the desired method. It will be appreciated that a variety of programming languages may be used to implement the teachings of the invention as described herein.

Embodiments of the invention include timepieces, clocks or other time display devices, which may include traditional mechanical or electro-mechanical clocks or watches, but which also may include computer or other displays or monitors including a display as discussed herein. For example, a computing device including a processor and a memory and other components (e.g. FIG. 7) may cause to be displayed on a monitor a time as discussed herein. Other embodiments of the invention include displays that show two physical or other parameters (e.g., temperature and humidity) on a single graphical display.

Figure 2:
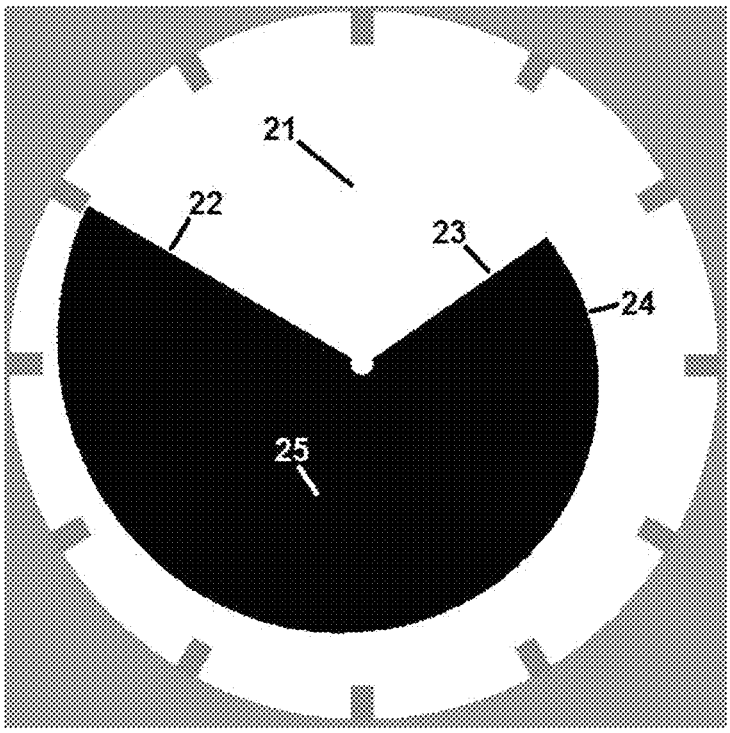
FIG. 2 shows an embodiment of the invention indicating fifty minutes after one o'clock.

One embodiment of the invention is a clock or timepiece having a face or display with two colored or patterned regions, a face (21) or background section, and a central shape (25), bounded by an hour segment (23), a minute segment (22), and a spiral (24), shown in FIG. 2. FIG. 2 depicts an embodiment of the invention showing fifty minutes after one o'clock. The face may be any simple geometrical shape traditionally used as faces of timepieces, such as a circle, oval, ellipse, square or rectangle, but also may be other shapes such as a triangle or diamond. The central shape may be the bounded region formed by connecting two line segments (22 and 23), which may correspond to the traditional hands of a timepiece, with a spiral (24) or other monotonically-increasing radial function r(Θ), where Θ (the Greek letter theta) will be used herein to designate this angle.

The polar angle Θ is measured from the intersection of the two hands, and the radial function is defined for the values of Θ spanning from $\Theta_{MINUTE}$ (the angle of the minute hand) to $\Theta_{HOUR}$ (the angle of the hour hand). The shape may be filled with a color or pattern, e.g. a uniform color, but in other embodiments, the shape need not be filled and may, for example, take on the coloring of the face or background. Thus, the shape is described in the polar coordinate system. The two line segments (22 and 23) may join or cross (e.g., at the center of the face or display), but this is not necessary. An example of r(Θ) may be a curve or spiral (24) such as a logarithmic spiral, such as shown in FIG. 2. A logarithmic spiral provides an elegant and functional solution, but other functions and shapes connecting the two hands or segments may be used. In addition, the bounds or edges of the curve connecting the distal ends of line segments 22 and 23 may be irregular, notched, wavy, non-smooth, etc. While face or background section 21 is traditionally round or oval, such a section may be other shapes such as square, rectangle, or a non-geometric shape.

In some embodiments, the central shape and/or the background face may each include or be filled with more than one uniform color, but may still be distinguishable from one another. In some embodiments, an hour and/or minute hand may be separately visible while being part of or bounding the central shape; in other embodiments hour or minute hands distinct from the central shape need not be used.

The lines or hands which provide a boundary for the central shape or other region may be of different length, as with a traditional timepiece. E.g., there may be a long hand or line segment and a short hand or line segment providing boundaries for a shape having an outer boundary of a curve or a spiral. The curve connecting the lines or hands may be a spiral or other curve whose distance from the center, or the point at which the hands meet or cross does not decrease as the outer border spans from the end of the short hand to the end of the long hand. That is, r(Θ) is monotonically increasing over the domain of Θ. Other embodiments of the invention use a radial function, r(Θ), that is monotonically increasing only over only the majority of, not the entirety of, the domain of Θ.

Figure 3:
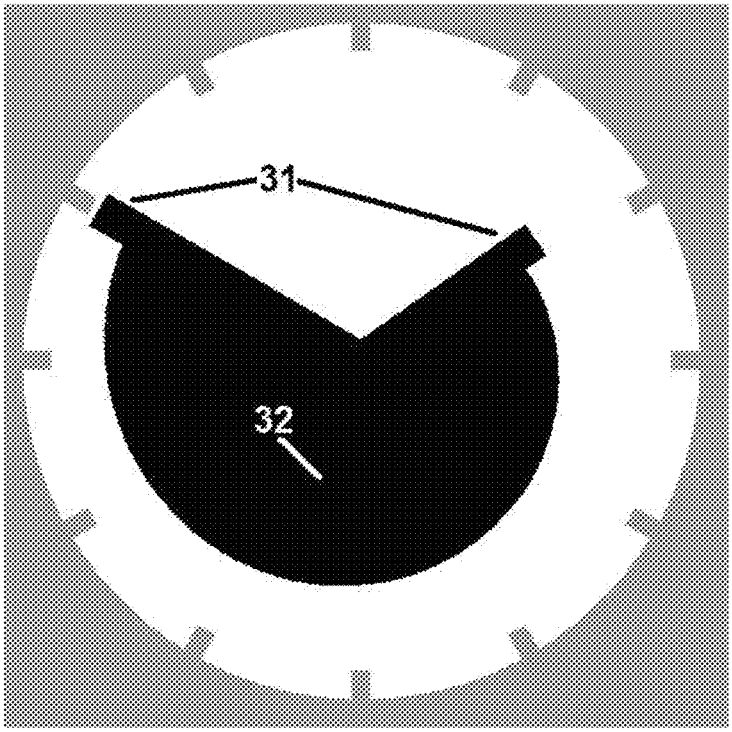
FIG. 3 shows an embodiment of the invention indicating fifty minutes after one o'clock using a hybrid of the traditional (31) and an embodiment of the shape (32).

Embodiments of the invention may display a shape that is defined by two lines and an outer spiral, but specific, separate hands need not be displayed. That is, the shape may be displayed as a block of color, including black or white, without separate lined borders or hands. However, when the hands are displayed, an embodiment may be combined with a traditional timepiece by superimposing the shape (32) on traditional clock or timepiece hands (31) as shown for example in FIG. 3. FIG. 3 depicts an embodiment of the invention indicating fifty minutes after one o'clock via a hybrid of shapes. Minute and hour hands can be seen extending beyond the central shape 32. Whether the indication of the hour and minute appear in an embodiment as pronounced hands (31), as in FIG. 3, or merely as borders (22 and 23) of the central shape, as in FIG. 2, the indicators are herein referred to as "hands".

Embodiments of the invention may follow a rule for determining the domain of angle that is spanned by the central shape. This rule in one embodiment is that the domain of Θ is the reflex angle (an angle larger than a straight angle but less than one turn; between 180° and 360°) formed by the hour and minute hands. Other embodiments of the invention may follow a rule such that the domain of angle Θ spanned by the central shape is the acute, right or obtuse angle formed by the hour and minute hands. An example of the latter embodiment is shown in FIG. 4 with an obtuse angle (41) forming the domain of Θ.

Figure 4:
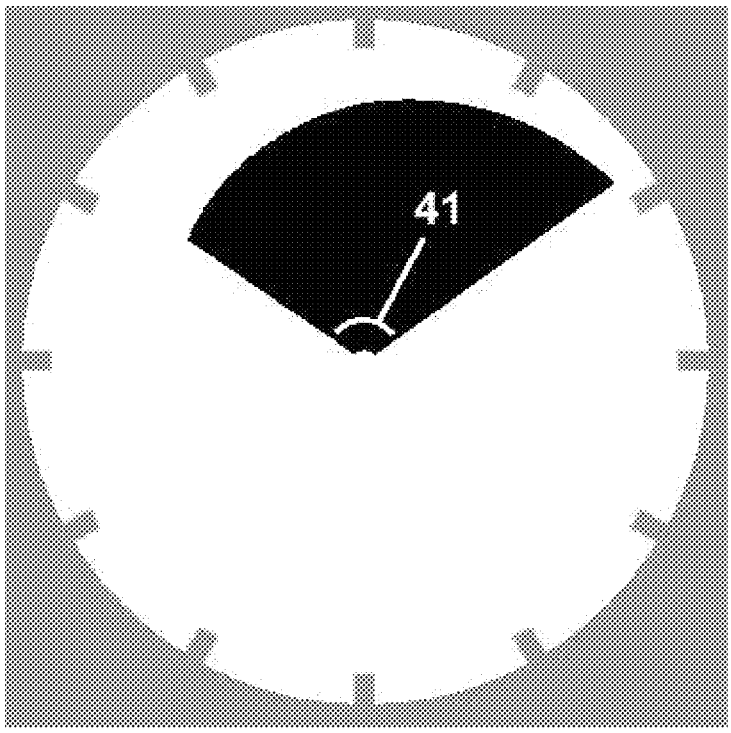
FIG. 4 shows an embodiment of the invention creating a central shape spanning the obtuse angle (41) formed by the hour and minute hand.

FIG. 4. shows an embodiment of the invention creating a central shape spanning the obtuse angle between the hour and minute hands.

One embodiment of the invention includes features wherein:

- The domain of Θ is the reflex angle formed by the hour and minute hands.
- A logarithmic spiral is used as the ideal curve connecting the hour and minute hands.
- A large number of triangles form the central shape so that the outer border of the shape is a piecewise-linear function that is visually indistinguishable from a logarithmic spiral.

A large number, N, of adjacent triangles may be used to produce a curve with a smooth appearance. The time to be displayed determines $\Theta_{HOUR}$, the angle of the hour hand, and $\Theta_{MINUTE}$, the angle of the minute hand. A processor (e.g., executing code or software) or another process or device may add integer multiples of 2π radians to $\Theta_{MINUTE}$ such that the absolute value of the difference between $\Theta_{HOUR}$ and $\Theta_{MINUTE}+2m\pi$ (where m is an integer) falls between π and 2π radians, inclusive. That is, the goal is to choose m such that the following equation is satisfied:

$$\pi \le |\theta_{Hour} - \theta_{MINUTE} - 2m\pi| \le 2\pi$$

The quantity $\Theta_{MINUTE}+2$ ml will be referred to as $\Theta_m$. Now calculate N+1 values of Θ in the domain of the radial function, according to the following equation:

$$\theta_k = \theta_{HOUR} + \frac{k(\theta_m - \theta_{HOUR})}{N};$$

for k=0, 1, . . . N

Next, a constant c may be calculated according to the following formula, where a and b are the lengths of the hour and minute hands, respectively:

$$c = \frac{\ln\left(\frac{b}{a}\right)}{\theta_m - \theta_{HOUR}}$$

The corresponding N samples may be calculated of the radial function according to the following equation, where the constants a dictates the length of the hour hand.

$r_k = ae^{c(\Theta_k - \Theta_{HOUR})}$; for $k=0,1,\ldots N$

The shapes may be drawn, for example using any commonly-available graphics routines or software package. The N triangles may be drawn, each defined by the following three vertices, for k=1, 2, . . . N:

the center of the face the point defined in polar coordinates as $(r_k, \Theta_k)$ the point defined in polar coordinates as $(r_{k-1}, \Theta_{k-1})$ For large enough N, the resultant shape will have a boundary that is indistinguishable by the naked eye from a logarithmic spiral (24 in FIG. 2). Values of N between 100 and 500 may be used to achieve a close approximation of the spiral. An irregular or stepped curve may also display the time, using lower values of N.

A graphical circle may be added to mark the center. In addition to the hour tick marks shown in FIG. 2, other ornamental or informative features may be added.

In an embodiment displaying the time, as the hands or the lines (22 and 23) defining the shape (25) move (with time, or with time updates), the shape defined by them may move, and the shape itself may present the time. In embodiments that present the time in hours and minutes, a third indicator that measures seconds may be added to the primary shape.

While the segments or hands (22 and 23 in FIG. 2) are labeled or indicate "minute" and "hour" in some embodiments, these meanings need not be used. Other embodiments of the invention may measure and present in a dial-like, or analog, manner any physical parameters. Between the two parameters displayed, the more rapidly changing parameter may be assigned for example to the longer hand 22, while the slower changing parameter may be assigned for example to the shorter hand 23. A non-limiting list of examples of parameters to be displayed includes:

time, measured in hours
time, measured in minutes
time, measured in seconds
cycle of coastal tides
phases of the moon
pressure, atmospheric or otherwise
temperature, atmospheric or otherwise
humidity
speed of a moving vehicle
tachometer of a moving vehicle
weight
price, e.g. for a butcher's scale Some embodiments have as the domain of the radial function the reflex angle (instead of the acute, obtuse or right angle) formed by the hour and minute segments. Two examples are described below to address the coloring of the central shape and face either when the separation of the hands reaches a straight angle or when the two hands overlap, as happens for example at twelve o'clock. Other methods may be used. In the case of the straight angle, shown in FIG. 5, the spiral boundary 54 of the central shape flips its direction of growth from counter-clockwise, as in 51, to clockwise, as in 52.

Figure 5:
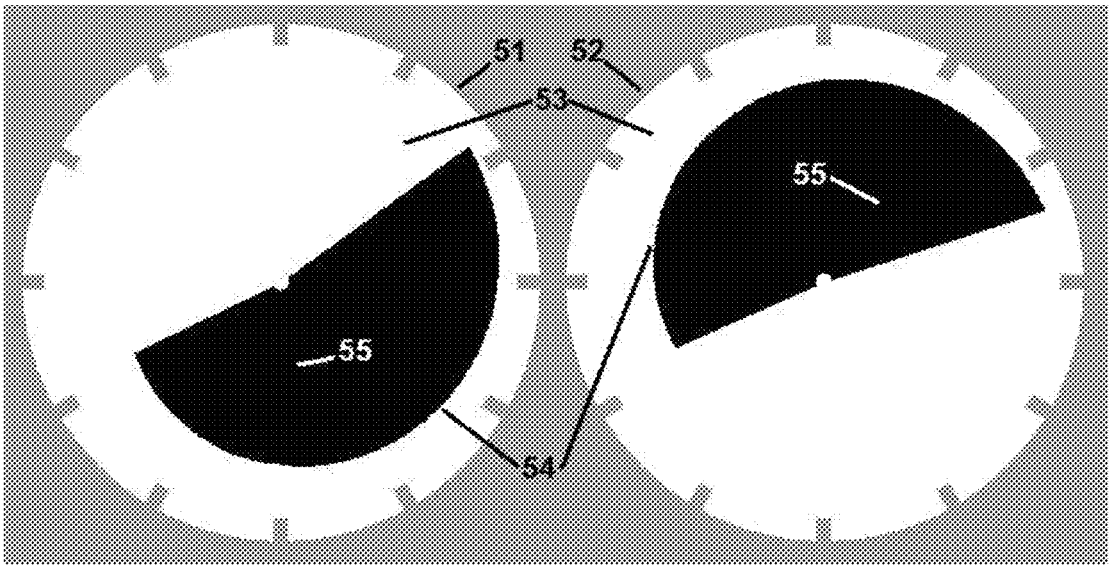
FIG. 5 shows an embodiment of the invention using a first method of transition, in which the colors or patterns of the face (53) and central shape (55) remain constant throughout the day.

FIG. 5 shows an embodiment of the invention and a method of transition. The left image shows nine minutes after eight o'clock while the right shows twelve minutes after eight o'clock. FIG. 5 shows configurations before (51) and after (52) the transition occurring when the hour and minute hands form a straight angle and the central shape's boundary (54) changes orientation. In one embodiment, shown in FIG. 5, transition may occur such that the central shape 55 and face 53 maintain their original colors or patterns while the spiral boundary reverses direction. FIG. 5 shows the embodiment before 51 and after 52 the transition. Thus, users may also distinguish the two hands according to the constantly-colored central shape itself 55.

Figure 6:
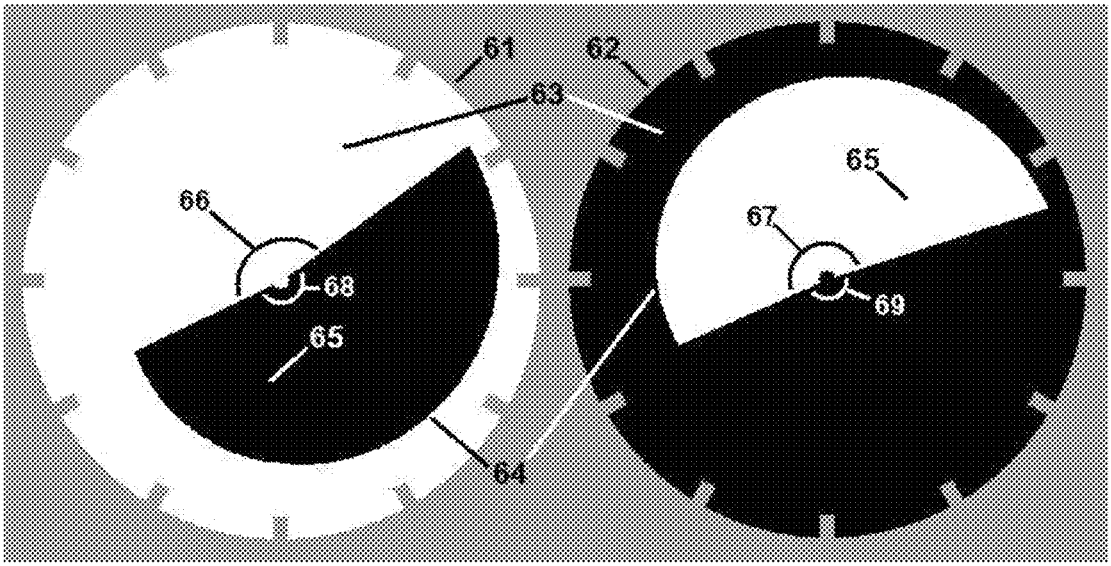
FIG. 6 shows an embodiment of the invention using a method of transition in which the colors or patterns of the face (63) and central shape (65) swap when the hands form a straight angle and also when the hands are coincident in angle.

FIG. 6 shows an embodiment of the invention and a method of transition. The left image shows nine minutes after eight o'clock while the right shows twelve minutes after eight o'clock. In FIG. 6, the central shape 65 and the face 63 may swap colors or patterns at the instant the spiral, growing either clockwise or counter-clockwise, reverses direction. FIG. 6 shows this embodiment before (61) and after (62) the transition, when the spiral (640) switches from counter-clockwise growth to clockwise growth. Another transition, not depicted, occurs when the hands align, e.g. at twelve o'clock. This method of transition may facilitate users to distinguish the two hands by the separation of a constantly-colored section of the embodiment, where this section spans the clockwise angle from the hour hand to the minute hand. This is a wedge-like section of face (66) formed between the two hands before the transition. And the central shape itself colors this section (67) the same after the transition. In the embodiment shown in FIG. 6, this section is constantly colored white. Under this method of transition, the section formed by the clockwise arc (66 and 67) from the hour hand to the minute hand will maintain color as the transition occurs. Likewise, under this method of transition, the section counterclockwise (68 before the transition and 69 after) from the hour hand to minute hand will maintain its color, black in FIG. 6, in color contrast to the to the clockwise-formed wedge, as the transition occurs. Other methods of transition may be used.

Embodiments of the invention may be, for example, a component of a clock or watch or may be implemented in software. Embodiments of the invention may be implemented using, for example, a single-board computer with an LCD screen display (e.g., FIG. 7) or it may be implemented in software on a personal computer (e.g., FIG. 7).

Figure 8:
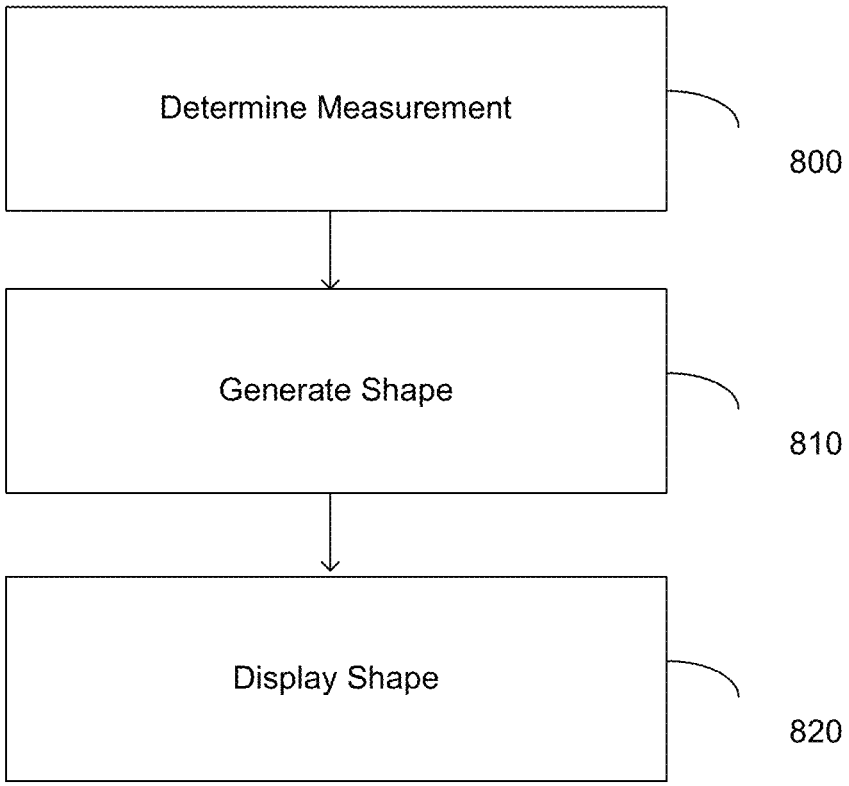
FIG. 8 is a flowchart depicting a method according to an embodiment of the present invention.

FIG. 8 is a flowchart depicting a method according to an embodiment of the present invention.

In operation 800 a device may determine a measurement, the measurement being a compound measurement including at least two parameters. For example, if the measurement is time the first parameter may be the hour and the second parameter may be the minute. The measurement may be determined or input by a clock or time keeper process in the case that the measurement is time. The measurement may be determined or input by a sensor or gauge such as a thermometer, tachometer, etc. The measurement may be, rather than a stored measurement, a stored parameter (e.g., a past time, a stored value, etc.).

In operation 810 a device may generate a shape. The shape may be a graphical shape (possibly filled, e.g., with color) bounded by:

1) originating at a center on a face displayed on the display, a first line segment, the first line segment indicating a first parameter (e.g., an hour) and having a first end at the center and distal end;
2) originating at said center, a second line segment longer than the first line segment the second line segment indicating a second parameter (e.g., a minute) and having a first end at the center and distal end; and
3) a curve beginning at the distal end of the short line segment and ending at the distal end of the long line segment and determined by a radial function that is monotonically-increasing over at least a majority of the radial distance between the distal ends of the line segments, with the origin at said center, over the domain of the reflex or straight angle formed at the center by the two line segments.

In operation 820 the shape may be displayed, e.g., on a monitor or display.

Other operations or series of operations may be used. For example, in a mechanical and non-computing device, the shape may be the result of mechanical operations of moving parts, and therefore operations 800-820 may be inherent and combined in the movement of the device.

Some prior art devices may include spirals or other curves in clock faces. However, these spirals do not indicate time in the manner of embodiments of the present invention. The time-invariance of such prior art spirals fail to employ one of the spiral's features, the shape of its curve; the hour indicator fails to impact the curve of the spiral. Some prior art devices including spirals also may introduce a new and confusing orientation of the minute hand.

Figure 7:
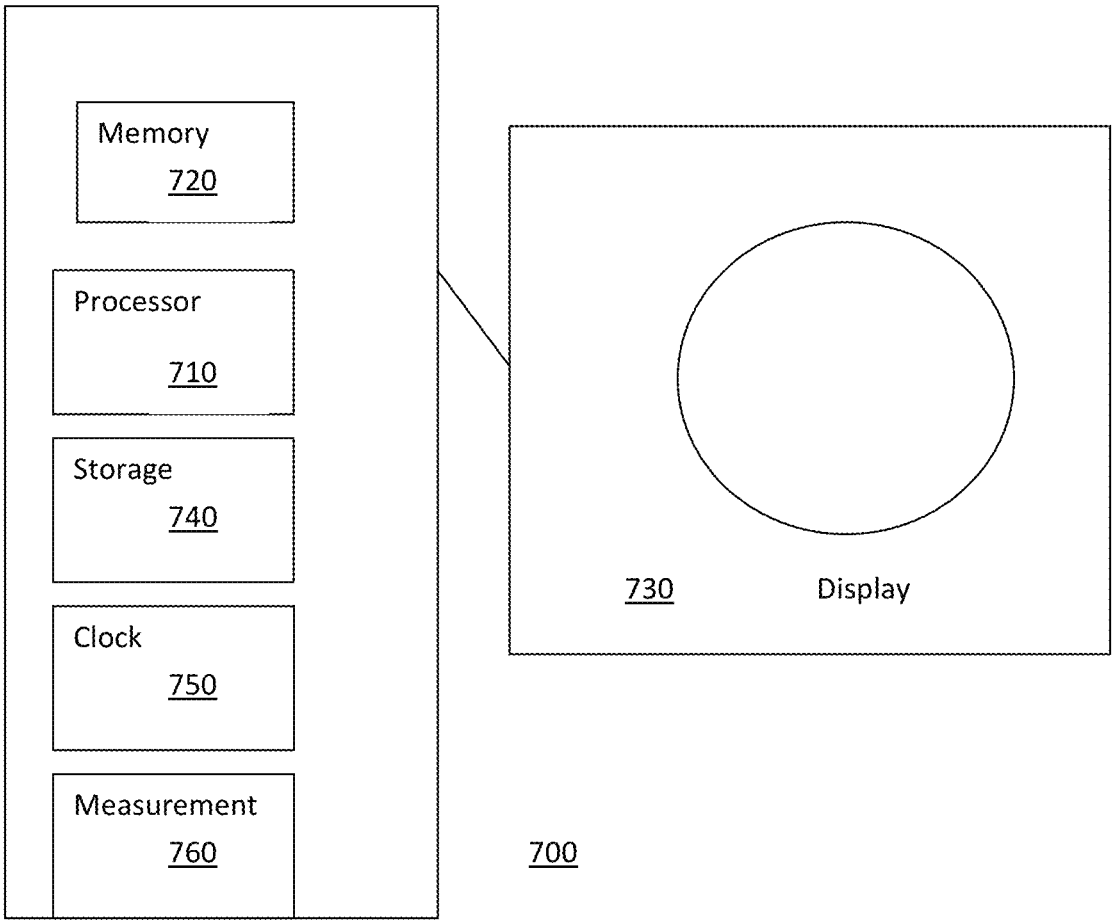
FIG. 7 shows an implementation of an embodiment of the invention.

FIG. 7 depicts a device according to one embodiment of the invention. The device (e.g. a display device) of FIG. 7 may carry out methods disclosed herein. Methods disclosed herein may be carried out by other devices, such as devices not using a processor, but rather using mechanical moving parts, such as a traditional timepiece built to display time in accordance with this invention, or a mechanical gauge (e.g., tachometer). FIG. 7 may include a device 700 such as a watch, clock, computer (e.g., personal computer, portable digital assistant, laptop, workstation, etc.), or other device. Processor or controller 710 may be a central processing unit or other processor, executing code or instructions stored in memory 720 to display data such as time on display 730. Display 730 may be a cathode ray tube, liquid crystal display, flat screen display, or other display. Memory 720 may store data such as time, configuration parameters, graphics data, etc. Long term storage 740 (e.g., a hard drive or other long term storage) may include instructions, code, or data. Device 700 may include a separate time keeper process 750, e.g., a clock such as an electronic clock, mechanical clock, computer-implemented clock, etc. Time keeper process 750 may provide the time (the current time, a past time, an elapsed time, etc.) to e.g. control 710 for display. Time keeper process 750 may be implemented by processor 710 executing code or software. In an embodiment where a device 700 displays information other than time, device 700 may include one or more measuring units 760, e.g., a tachometer, speedometer, pressure gauge, thermometer, etc. to provide measurements of physical or other parameters to e.g. control 710 for display.

Some embodiments of the invention may be implemented, for example, using a computer or machine-readable medium such as, for example, a memory circuit and/or an article (e.g., memory 720 or long term storage 740) which may store an instruction and/or a set of instructions that, when executed by a machine, cause the machine to perform a method and/or operations in accordance with embodiments of the invention. Such a machine may include, for example, any suitable processing platform, computing platform, computing device, processing device, computing system, processing system, computer, processor, or the like, and may be implemented using any suitable combination of hardware and/or software. The machine-readable medium or article may include, for example, any suitable type of memory unit, memory device, memory article, memory medium, storage device, storage article, storage medium and/or storage unit or the like. The instructions may include any suitable type of code, for example, source code, compiled code, interpreted code, executable code, static code, dynamic code, or the like, and may be implemented using any suitable high-level, low-level, object-oriented, visual, compiled and/or interpreted programming language, e.g., C, C++, Java, assembly language, machine code, or the like.

Thus, embodiments of the invention may present a bold geometrical figure that may be easily viewed with obscured vision or from a distance, especially when the colors of the face and the spiral shape are chosen to provide a significant visual contrast. This geometrical figure may be more understandable and legible than the thin hands of analog timepieces. Finally, the minimalistic, high-contrast, elegant, and intuitive display provides a better user experience.

The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

The invention claimed is:

1. A display device comprising:

an electronic display unit capable of rendering graphics; and a processor to:

render on said display a filled graphical shape bounded by the following:

originating at a center on a face displayed on the display, a first line segment, the first line segment indicating a first parameter and having a first end at the center and a distal end;

originating at said center, a second line segment longer than the first line segment the second line segment indicating a second parameter and having a first end at the center and a distal end; and a curve beginning at the distal end of said first line segment and ending at the distal end of said second line segment and determined by a radial function that is monotonically-increasing over at least a majority of the radial distance between the distal ends of the line segments, with the origin at said center, over the domain of the reflex or straight angle formed at the center by the two line segments;

the graphical shape indicating a measurement, the measurement selected from the group consisting of: one or more physical measurements; and time, wherein the first parameter is the hour and second parameter is the minute.

2. A display device according to claim 1, wherein the selection from the group of measurements is one or more physical measurements, the one or more physical measurements comprising two physical measurements and the angle between the first line segment and a fixed reference angle is proportional to the first of the two physical measurements, and wherein the angle between the second line segment and the fixed reference angle is proportional to the second of the two physical measurements.

3. A display device according to claim 1, wherein the monotonically-increasing radial function forming a boundary of the shape has a domain consisting of the acute, right, or obtuse angle formed by the two segments.

4. A display according to claim 1, wherein the curve connecting the distal ends of said segments is determined by a radial function that is monotonically-increasing over the entirety of the radial distance between the distal ends of the line segments.

5. A display device according to claim 1, wherein the processor is to display an indication of the number of seconds elapsed.

6. A display device according to claim 1, comprising a set of clock hands.

7. A display device according to claim 1 wherein the selection from the group of measurements is time, the time comprising the current time.

8. A display device according to claim 1 comprising a memory.

9. A method for displaying information comprising:

displaying on a display a filled graphical shape bounded by the following:

originating at a center on a face displayed on the display, a first line segment, the first line segment indicating an first parameter and having a first end at the center and a distal end; and originating at said center, a second line segment longer than the first line segment the second line segment indicating a second parameter and having a first end at the center and a distal end; and a curve beginning at the distal end of said first line segment and ending at the distal end of said second line segment and determined by a radial function that is monotonically-increasing over at least a majority of the radial distance between the distal ends of the line segments, with the origin at said center, over the domain of the reflex or straight angle formed at the center by the two line segments;

the graphical shape indicating a measurement, the measurement selected from the group consisting of: one or more physical measurements; and time, wherein the first parameter is the hour and second parameter is the minute.

10. The method of claim 9 wherein the selection from the group of measurements is time, the time comprising the current time.

11. The method of claim 9, wherein the selection from the group of measurements is one or more physical measurements, the one or more physical measurements comprising two physical measurements and the angle between the first line segment and a fixed reference angle is proportional to the first of two physical measurements, and wherein the angle between the second line segment and the fixed reference angle is proportional to the second of two physical measurements.

12. The method of claim 9, wherein the monotonically-increasing radial function forming a boundary of the shape has a domain consisting of the acute, right, or obtuse angle formed by the two segments.

13. The method of claim 9, wherein the curve connecting the distal ends of said segments is determined by a radial function that is monotonically-increasing over the entirety of the radial distance between the distal ends of the line segments.

14. The method of claim 9, comprising displaying an indication of the number of seconds elapsed.

15. The method of claim 9, comprising displaying a set of clock hands.

* * * * *